United States Patent [19]

Dann

[11] Patent Number: 4,632,009

[45] Date of Patent: Dec. 30, 1986

[54] APPARATUS FOR FEEDING POWDER

[75] Inventor: Thomas E. Dann, Parsons, Kans.

[73] Assignee: Day & Zimmerman Inc., Philadelphia, Pa.

[21] Appl. No.: 684,831

[22] Filed: Dec. 21, 1984

[51] Int. Cl.[4] ..... F42B 33/02; B67D 5/64; B65B 21/02

[52] U.S. Cl. ..... 86/31; 86/29; 86/33; 86/20.1; 222/161; 222/165; 222/166; 222/167; 222/168; 414/421

[58] Field of Search ..... 86/25, 29, 20 R, 23, 86/31, 33; 222/161, 160, 164, 165, 166, 167, 168, 196, 199, 200, 346, 357, 358, 362; 42/90; 414/421, 415

[56] References Cited

U.S. PATENT DOCUMENTS

| | | | |
|---|---|---|---|
| 366,744 | 7/1887 | Stahl | 86/29 |
| 536,685 | 4/1895 | Crosby | 86/29 |
| 3,147,890 | 9/1964 | Mittelsteadt | 222/165 |
| 3,157,086 | 11/1964 | Bachhuber | 86/27 |
| 3,237,787 | 3/1966 | Peterson | 222/161 |
| 3,383,020 | 5/1968 | Cargile | 222/168 |
| 3,558,009 | 1/1971 | Carter | 222/161 |
| 3,580,128 | 5/1971 | Leich | 86/29 |
| 4,363,589 | 12/1982 | Rozwadowski et al. | 222/161 |

OTHER PUBLICATIONS

Stein, ed. 1982, The Random House College Dictionary, Revised Edition, Random House, Inc., New York, p. 940.

*Primary Examiner*—Stephen J. Lechert, Jr.
*Assistant Examiner*—Howard J. Locker
*Attorney, Agent, or Firm*—Seidel, Gonda, Goldhammer & Abbott

[57] ABSTRACT

Explosive powder is fed to a receptacle within a barricade by means of a tube which is open at only one end. A first motor is provided for pivoting the tube between an upright refill position and a dispensing position wherein the longitudinal axis of the tube is slightly below horizontal. A second motor is coupled to the tube for movement therewith and for rotating or oscillating the tube about its longitudinal axis to cause powder to be dispensed from the tube.

9 Claims, 4 Drawing Figures

FIG. 1
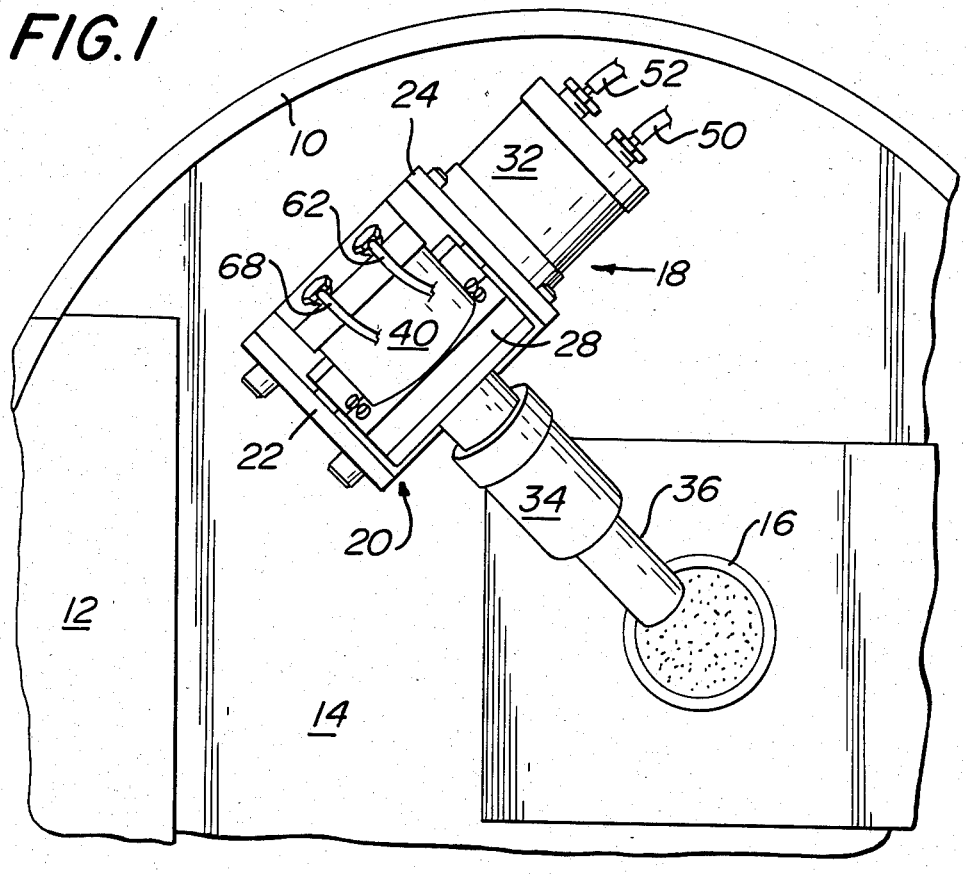
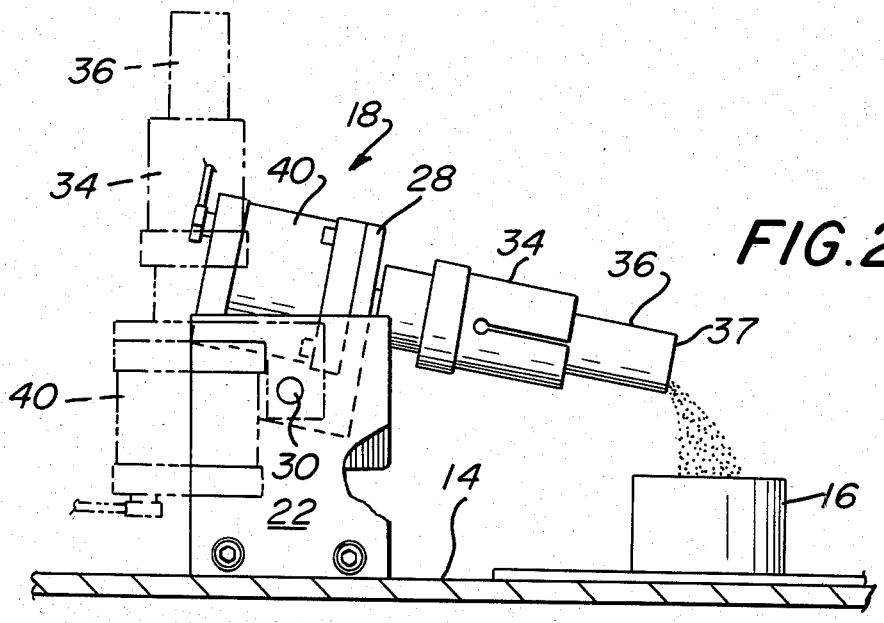
FIG. 2

APPARATUS FOR FEEDING POWDER

BACKGROUND OF THE INVENTION

Apparatus for loading detonators with explosive powder is disclosed in U.S. Pat. No. 3,383,020. In actual practice, the receptacle 88 in said patent was periodically removed and replaced with a full receptacle after first shutting down the apparatus. Hence, when practicing the invention disclosed in said patent, there is substantial material handling of receptacles which are filled with powder or partially empty. There has long been a need for a simple reliable means for intermittently feeding powder to the receptacle in said patent. The present invention is directed to a solution of that problem.

SUMMARY OF THE INVENTION

The present invention is directed to apparatus for feeding powder. The apparatus includes a frame on which is mounted a tube. The tube is open at one end and closed at its other end. The tube is mounted on the frame for pivotable movement about a horizontal axis between a first upright position and a second position wherein the longitudinal axis of the tube is just below the horizontal. A first motor is coupled to the tube for oscillating the tube between said positions. A second motor is movable with the tube as said tube is pivoted between said positions. The second motor is arranged to oscillate the tube about its longitudinal axis for feeding powder from the open end of the tube.

It is an object of the present invention to provide novel apparatus for feeding powder in a manner which is simple and reliable.

It is another object of the present invention to provide apparatus for intermittently dispensing explosive powder to a receptacle within a barricade and being capable of operation from outside the barricade.

Other objects and advantages of the present invention will appear hereinafter.

For the purpose of illustrating the invention, there is shown in the drawings a form which is presently preferred; it being understood, however, that this invention is not limited to the precise arrangements and instrumentalities shown.

FIG. 1 is a partial plan view of a detonator loading apparatus within a barricade.

FIG. 2 is a side elevation view of the feeder.

DETAILED DESCRIPTION

Figure 3:
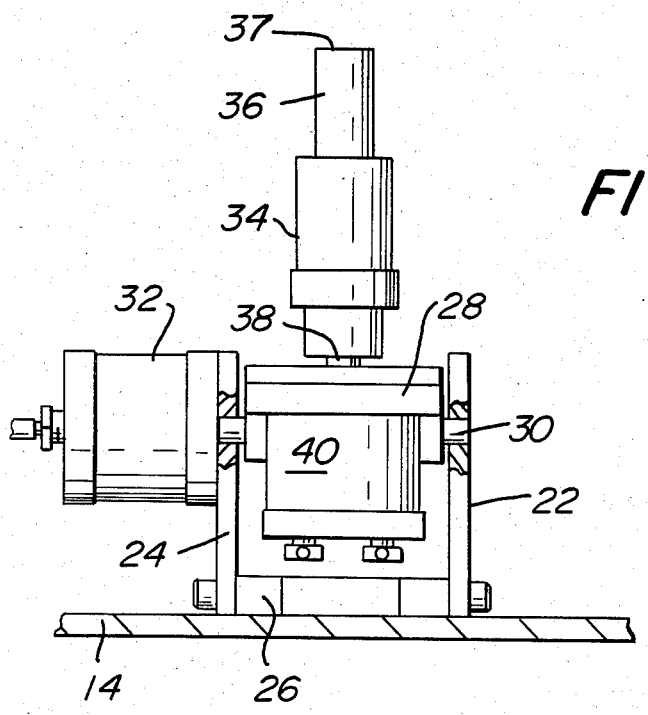
FIG. 3 is a rear elevation view of the feeder.

Referring to the drawing in detail, wherein like numerals indicate like elements, there is shown in FIG. 1 apparatus for loading explosive detonators or other devices within a barricade 10. The barricade 10 has an access way 12 to facilitate visual as well as mechanical intrusion into the barricade 10. The barricade 10 includes a horizontal wall 14 which in turn supports a receptacle 16. Receptacle 16 performs the function of receptacle 88 disclosed in the above-mentioned U.S. Pat. No. 3,383,020.

A feeder apparatus is provided for feeding powder to the receptacle 16 in an intermittent manner while being capable of operation from a location outside of the barricade 10. The apparatus 18 includes a stationary frame designated generally as 20. The frame 20 includes spaced parallel upright side walls 22 and 24 connected at their lower end to a plate 26 therebetween. Plate 26 is removably attached to the wall 14 in any convenient manner. The frame 20 supports a mounting means 28 for pivotal movement about a horizontal axis defined by the axle 30 integral therewith.

A first motor 32 is supported by the side wall 24 and connected to the axle 30 for oscillating the same. The motor 32 is preferably a pneumatic motor or an equivalent thereof which does not involve the possibility of generating a spark within the barricade 10.

The mounting means 28 is connected to an adapter 34 which in turn is telescopically arranged with respect to a tube 36. The tube 36 is open at one end designated 37 and is closed at its other end in any convenient manner. Tube 36 is releasably connected to adapter 34 in any convenient manner. Tube 36 preferably has a size so as to accomodate 15–20 grams of explosive powder and is made of polished steel.

A second motor 40 is attached to the mounting means 28 and has its output shaft 38 coaxial with and connected to the adapter 34. Motor 40 is preferably a pneumatic motor for the same reasons as set forth above in connection with motor 32. Motor 40 remains at all times coupled to the adapter 34 and the tube 36 supported thereby so that the tube 36 may be rotated about its longitudinal axis. See FIG. 2 wherein the feeder is shown in solid lines in its feeding position for feeding powder to the receptacle 16 and shown in phantom in a refill position. While in the upright position, the tube 36 is preferably removed and replaced with a new filled tube.

Figure 4:
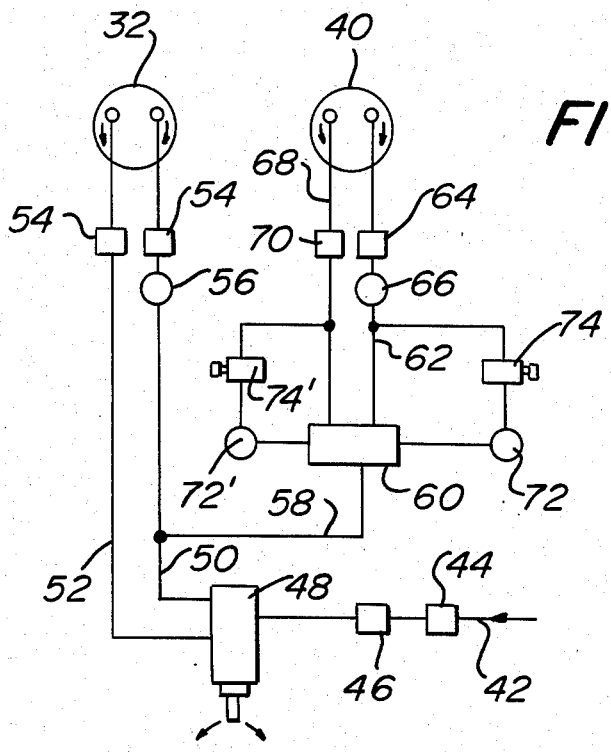
FIG. 4 is a diagrammatic illustration of circuitry for operating the feeder.

Referring to FIG. 4, there is shown the circuitry for intermittently operating the feeder 18. Except for motors 32 and 40, the structure shown in FIG. 4 is outside barricade 10. An air supply line 42 is provided with a filter 44 and a pressure regulator 46 and a valve 48 in series. The valve 48 is a supply and exhaust valve. The valve 48 communicates with the first motor 32 by way of conduits 50 and 52. Each of the conduits 50 and 52 may include a vent valve 54. Conduit 50 also includes a lubricator 56.

A conduit 58 has one end connected to conduit 50 at a location between lubricator 56 and valve 48. The other end of conduit 48 is connected to an accumulator timer valve 60. The accumulator timer valve 60 communicates with the second motor 40 by way of conduits 62 and 68. Conduit 62 may include a vent valve 64 and a lubricator 66. Conduit 68 may include a vent valve 70.

Conduit 62 is provided with a by-pass containing a chamber 72 and a vent valve 74. Conduit 68 is provided with a similar by-pass with corresponding elements identified by corresponding primed numerals.

The apparatus of the present invention is used as follows. The apparatus of the present invention is operated in timed relation with respect to the apparatus disclosed in U.S. Pat. No. 3,383,020 so that the receptacle 16 is intermittently fed with explosive powder. The feeder 18 has an upright position as shown in phantom in FIG. 2 and tube 36 is filled with an explosive powder. The supply of pressurized air via conduit 50 retains the feeder 18 in the upright position as shown in phantom in FIG. 2. When motor 32 is activated, the feeder 18 is oscillated from the upright phantom position to the solid line position as shown in FIG. 2 wherein the longitudinal axis if tube 36 is slightly below horizontal. I have found that an angle of about 10° below horizontal is satisfactory. Motor 32 has internal limit stops for limiting the extent of oscillation of tube 36.

When the tube 36 reaches the position as shown in solid lines in FIG. 2, motor 32 shuts off and motor 40 is initiated. Motor 40 is alternately supplied pneumatic pressure via conduits 62, 68 by the accumulator timer 60 so as to rotate or oscillate initially in one direction though an arc and then in an opposite direction through a similar arc. A suitable arc is 270° in each direction. The oscillation of the tube 36 about its longitudinal axis feeds the powder from the open end 37 into the receptacle 16.

Valve 48 is manually operated. Pressurized air from conduit 58 is first directed by timer valve 60 to conduit 68. The setting on valve 74' controls the rate at which pressurized air flows into chamber 72'. When the pressurized air reaches a preset valve in chamber 72', it shifts a spool in timer valve 60 so that conduit 58 communicates with conduit 62. Motor 40 will now oscillate in the reverse direction. The sequence is repeated with the spool in valve 60 being shifted before motor 40 has made a complete revolution in either direction. When all of the powder has been dispensed, valve 48 is manually shifted to shut off motor 40 and to cause motor 32 to return the tube 36 to its upright position. Thereafter, the empty tube 36 is replaced with a new tube 36 containing powder to be dispensed. Thereafter, the process is repeated.

All controls for operating the feeder 18 are located outside the barricade 10. The controls may be manually or automatically operated. Thus, it will be noted that the feeder 10 is simple, reliable, and effective for intermittently feeding powder to the receptacle 16 while being disposed within the barricade 10 and operated from outside the barricade 10.

The present invention may be embodied in other specific forms without departing from the spirit or essential attributes thereof and, accordingly, reference should be made to the appended claims, rather than to the foregoing specification, as indicating the scope of the invention.

I claim:

1. An apparatus for feeding explosive powder comprising a frame, a tube opened at one end and closed at its other end, means mounting said tube on said frame for pivotable movement about a horizontal axis between a first position wherein the tube is upright and a second position wherein the axis of the tube is just below horizontal, a first motor coupled to said tube for oscillating said tube between said positions, a second motor movable with said tube as said tube is pivoted between said positions, said second motor being arranged to rotate the tube about its longitudinal axis repetitively in opposite directions when said tube is in its second position for feeding powder from said open end of said tube.

2. Apparatus in accordance with claim 1 wherein said horizontal axis is closer to the closed end of the tube than to the open end of the tube.

3. Apparatus in accordance with claim 1 wherein each of said motors are pneumatic motors.

4. Apparatus in accordance with claim 1 including a barricade, a receptacle within said barricade, said tube being arranged to feed powder to said receptacle.

5. Apparatus for feeding explosive powder to a receptacle comprising a tube opened at one end and closed at its other end, the inner surface of said tube being a smooth polished surface, means supporting said tube for pivotable movement between an upright position and a dispensing position, the longitudinal axis of said tube being generally horizontal in its dispensing position, a first fluid motor for oscillating said tube between said positions, a second fluid motor coupled to said tube to rotate the tube about its longitudinal axis repetitively in opposite directions when said tube is in its dispensing position for feeding powder from said open end of said tube, and a barricade within which said tube is supported on a wall thereof.

6. Apparatus in accordance with claim 5 including circuitry for operating said motors, said circuitry including a conduit for supplying pressurized air, said conduit including a supply and exhaust valve having an outlet coupled to each of said motors, and an accumulator timer means coupled to said second motor and being disposed between said supply and exhaust valve and said second motor for alternating the direction of movement of said second motor.

7. Apparatus in accordance with claim 5 wherein said motor is arranged to rotate the tube about its axis in opposite directions through an arc of approximately 270°.

8. Apparatus in accordance with claim 5 wherein said first motor is arranged to oscillate said tube through an arc of approximately 100° as the tube moves between said positions.

9. Apparatus in accordance with claim 5 wherein said tube has a volume capable of dispensing approximately 15–20 grams of explosive powder.

* * * * *